US006954596B2

(12) United States Patent
Saito et al.

(10) Patent No.: US 6,954,596 B2
(45) Date of Patent: Oct. 11, 2005

(54) STORAGE AREA STORING INFORMATION OF THE AMOUNT OF USE OF EACH FEATURE OF DIFFERENT IMAGE FORMING APPARATUSES, A CARTRIDGE HAVING SUCH A STORAGE AREA, AND AN IMAGE FORMING APPARATUS MOUNTING SUCH A CARTRIDGE

(75) Inventors: Masanobu Saito, Shizuoka (JP); Marehiko Hirajima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/649,835

(22) Filed: Aug. 28, 2003

(65) Prior Publication Data

US 2004/0091274 A1 May 13, 2004

(30) Foreign Application Priority Data

Aug. 30, 2002 (JP) ..... 2002-253899
Aug. 27, 2003 (JP) ..... 2003-302521

(51) Int. Cl.[7] ..... G03G 15/00
(52) U.S. Cl. ..... 399/24; 399/25
(58) Field of Search ..... 399/9, 12, 24, 399/25, 111, 31

(56) References Cited

U.S. PATENT DOCUMENTS 5,184,178 A * 2/1993 Takayanagi et al. ..... 399/16
5,475,472 A 12/1995 Saito et al. ..... 355/219
5,669,042 A 9/1997 Kobayashi et al. ..... 399/111
6,128,448 A 10/2000 Arcaro et al. ..... 399/27
6,493,519 B2 12/2002 Sasame et al. ..... 399/25
6,714,745 B2 * 3/2004 Sasame et al. ..... 399/25
6,792,216 B2 * 9/2004 Wachter et al. ..... 399/8
2003/0044198 A1 3/2003 Kato et al. ..... 399/109

FOREIGN PATENT DOCUMENTS

EP 0 395 320 10/1990
EP 1 109 073 6/2001

* cited by examiner

*Primary Examiner*—Hoan Tran
(74) *Attorney, Agent, or Firm*—Fitzpatrick, Cella, Harper & Scinto

(57) ABSTRACT

An image forming apparatus in which information regarding used amounts in image forming apparatus main bodies of different features is stored in the storage part of a cartridge, and the interchange time of the cartridge is judged by the use of the information. Thereby, even if a cartridge having interchangeability between a plurality of kinds of image forming apparatus main bodies of different features is mounted on each of the main bodies of different features, an interchange time corresponding to the main body can be grasped accurately.

24 Claims, 8 Drawing Sheets

STORAGE AREA STORING INFORMATION OF THE AMOUNT OF USE OF EACH FEATURE OF DIFFERENT IMAGE FORMING APPARATUSES, A CARTRIDGE HAVING SUCH A STORAGE AREA, AND AN IMAGE FORMING APPARATUS MOUNTING SUCH A CARTRIDGE

BACKGROUND OF THE INVENTION

1. Field of the Invention

This invention relates to an image forming apparatus such as a copying machine or a laser beam printer of an electrophotographic type, and a cartridge detachably attachable to the image forming apparatus.

2. Related Background Art

A known image forming apparatus using an electrophotographic recording process, for example, a laser beam printer, is provided with a photosensitive drum functioning as an image bearing member that is rotatably driven, a charging roller functioning as charging means for uniformly charging the surface of the photosensitive drum, a laser for exposing the surface of the photosensitive drum to light and forming an electrostatic latent image corresponding to an image signal, developing means for developing the electrostatic latent image with a toner and forming a visible image, a transferring roller for transferring the visible image (developer image) onto recording paper in the form of a sheet, fixing means for fixing the visible image transferred onto the recording paper, cleaning means, etc.

In this image forming apparatus, it is known to make the photosensitive drum and the charging roller integral with the cleaning means or the developing means and making them into a cartridge, and to make this cartridge (hereinafter referred to as the process cartridge) detachably attachable to the image forming apparatus to thereby realize a maintenance-free image forming apparatus.

In such an image forming apparatus, when for example, the functions of the constituent parts incorporated in the process cartridge are lowered by a long period of use, the entire process cartridge is interchanged.

This interchanging work (process) is a very simple process of opening the main body of the image forming apparatus by one touch, taking out the old process cartridge from the interior of the main body of the image forming apparatus, and mounting an unused new process cartridge on the main body of the image forming apparatus, and can be carried out easily by an operator himself.

The life (interchange time) of this process cartridge is determined chiefly by the abrasion of the photosensitive drum and the developing roller and the consumption of the toner. The abrasion of the photosensitive drum and the developing roller can be schematically calculated from their total number of revolutions. The life (interchange time) can be calculated from the total number of printed sheets proportional to the total number of revolutions. Also, the consumption of the toner can be detected by toner remaining amount detecting means.

The amount of remaining toner can be detected each time. The process cartridge, however, can be arbitrarily interchanged by the user and therefore, it is desirable that the total number of printed sheets regarding the life of the photosensitive drum and the developing roller be kept in custody in the process cartridge.

For example, there is known a method of storing life information in a memory mounted on the process cartridge.

On the other hand, even in image forming apparatuses having different features (different kinds of apparatuses), when only the number of sheets printable within a minute differs, the process cartridges are sometimes made common. If the process cartridge is changed each time an image forming apparatus is put on sale as a new product, an increase in the cost of production and further, a place of custody for the process cartridge in connection with sale will become necessary for each type of machine. So, it is desirable that the process cartridges, which are expendibles, be made common as far as possible.

Also, there are generally two methods of making the number of sheets printable within a minute different. To increase the number of printed sheets per unit time, there are a method of increasing the rotating speed itself of the photosensitive drum, and a method of narrowing the interval between sheets undergoing continuous printing. This interval between the sheets will hereinafter simply be called the inter-sheet.

When the rotating speed of the photosensitive drum is increased, this main body does not differ in the relation between the total number of revolutions and the total number of printed sheets from a main body having its rotating speed kept as it is. This is because the number of printed sheets increases in proportion to an increase in the number of revolutions per unit time.

Accordingly, if the total number of printed sheets concerned with the total number of revolutions is stored in a memory, the life (interchange time) of the photosensitive drum, the developing roller, etc., can be correctly calculated even by a conventional calculating method, even between main bodies differing in printing speeds from each other.

On the other hand, in a method of shortening the inter-sheet, the rotating speed of the photosensitive drum is equal between the respective main bodies, and the conveying speed of the sheet is also equal between the respective main bodies. Accordingly, various conditions concerning an image, such as a laser applying condition and a fixing condition can be made constant and therefore, not only the image forming apparatus can be developed within a short period, but also various parts can be made common and therefore, the cost of the apparatus and the reliability of the parts can be improved.

However, when the inter-sheet is shortened to thereby make the number of printed sheets per unit time (a minute) different, the relation between the total number of revolutions of the photosensitive drum, the developing drum, etc., and the total number of printed sheets becomes different between the main bodies of image forming apparatuses having different features. In the main body wherein the inter-sheet is narrowed, as compared with the main body in which the inter-sheet is kept as it is, the rate of the time of the inter-sheet during which an image is not printed becomes short. That is, the ratio of the time contributing to printing increases and therefore, in the main body in which the inter-sheet is short relative to the same total number of revolutions, the total number of printed sheets becomes greater.

Accordingly, when the life (interchange time) of the photosensitive drum and the developing roller is to be calculated, the conventional calculating method is not successful between the main bodies differing in the inter-sheet from each other.

So, there is also a method of uniformly adjusting the setting of the threshold value of the total number of printed sheets to the main body in which the inter-sheet is longer.

However, in spite of the ability of a main body in which the inter-sheet is shortened to print more, the cartridge's life must be shortened in conformity to the main body whose inter-sheet is long, since the cartridge can be used in main bodies whose inter-sheet is short or long, and is cannot be said to be an effective method. Particularly, when the photosensitive drum is abraded and exceeds its life, it is desirable to turn on the end of life lamp of the image forming apparatus, once stop printing, and call upon the user to interchange the process cartridge. The reason why the main body is once stopped by the life of the photosensitive drum is for preventing the occurrence of such a faulty image as will produce damage to the main body, such as twining or a jam in the fixing device due to the photosensitive drum having exceeded its life.

Also, in some cases, the user employs two kinds of main bodies, i.e., a main body in which the inter-sheet is short and a main body in which the inter-sheet is long. If the process cartridge has interchangeability, there is the possibility of the same process cartridge being alternately mounted on the two main bodies. In this case, there may occur the absurdity that the process cartridge reaches the end of its life in one main body and does not reach the end of its life in the other main body.

SUMMARY OF THE INVENTION

The present invention has been made in view of the above-noted problem and an object thereof is to accurately determine the life (interchange time) of a cartridge having interchangeability and detachably attachable to main bodies having different features.

Also, an object of the present invention is to accurately determine the life interchange time) of a cartridge having interchangeability and detachably attachable to main bodies having different features.

Therefore, the present invention is designed to provide an image forming apparatus and a process cartridge shown below, and a storing medium carried on the cartridge to thereby achieve the above objects.

The image forming apparatus of the present invention has a mounting portion on which a cartridge, having at least some of the members necessary for image forming and a storage part and detachably attachable to image forming apparatuses of different features, is mounted, and a control part for determining the interchange time of the cartridge in conformity with information stored in the storage part. The storage part has a storage area for storing therein information on the used amount of each feature of the image forming apparatuses, and the control part determines the interchange time of the cartridge in conformity with the information of the used amount fo each feature stored in the storage area of the storage part.

The cartridge of the present invention is a cartridge having at least some of the members necessary for image forming and a storage part, and is detachably attachable to the mounting portions of image forming apparatuses having different features that have a control part for determining the interchange time of the cartridge in conformity with information stored in the storage part. The storage part has a storage area for storing therein information on the used amount of each feature.

The storage medium of the present invention is a storage medium carried on a cartridge having at least some of members necessary for image forming and a storage part, and is detachably attachable to the mounting portions of image forming apparatuses having different features. The storage medium includes a storage area for storing therein information on the used amount of each feature.

Further objects of the present invention will become apparent from the following detailed description of the invention when read with reference to the accompanying drawings.

DESCRIPTION OF THE PREFERRED EMBODIMENTS

Some embodiments of the present invention will hereinafter be described in detail and specifically with respect to an embodiment of an in-line type color printer with reference to the drawings.

Constructions described in the following embodiments are illustrative to the last and the scope of the present invention is not restricted thereto.

(First Embodiment)

Figure 1:
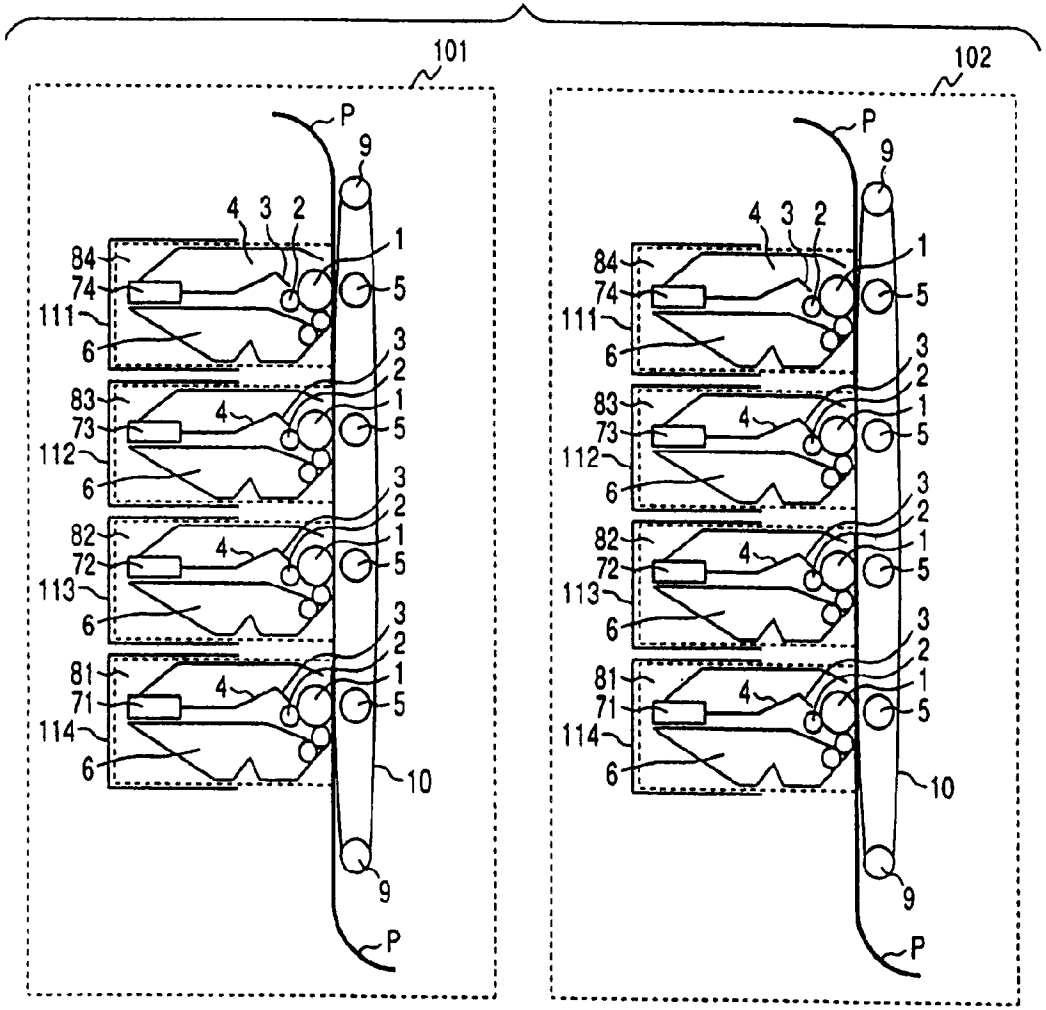
FIG. 1 is a cross-sectional view schematically showing the construction of the image forming parts of image forming apparatuses in a first embodiment of the present invention.

FIG. 1 is a cross-sectional view schematically showing the construction of the image forming parts of color image forming apparatuses utilizing an electrophotographic process according to a first embodiment of the present invention.

The image forming apparatus 101 and the image forming apparatus 102 are image forming apparatuses which are the same in apparatus construction but differ in their features. In this case, the interval between sheets P being conveyed differs between the image forming apparatus 101 and the image forming apparatus 102.

The reference numeral 1 designates rotary drum-shaped electrophotographic photosensitive members (hereinafter referred to as the photosensitive drums), the reference numeral 2 denotes primary charging rollers, which are charging means, the reference numeral 3 designates cleaning means, the reference numeral 4 denotes cleaning containers, the reference numeral 5 designates transferring rollers, which are transferring means, the reference numeral 6 denotes developing devices, and the reference numeral 9 designates tension rollers. The reference numerals 71 to 74 denote cartridge members that are nonvolatile memories, the reference numerals 81 to 84 designate process cartridges each having the photosensitive drum 1, the primary charging roller 2, the cleaning means 3, the cleaning container 4, the developing device 6 and the cartridge memories 71 to 74, respectively, and the reference numerals 111, 112, 113 and 114 denote mounting portions for mounting the process cartridges 81 to 84 thereon, respectively. The reference numerals 101 and 102 designate image forming main bodies of discrete kinds differing from each other in their features, and the letter P denotes a transferring material.

Figure 2:
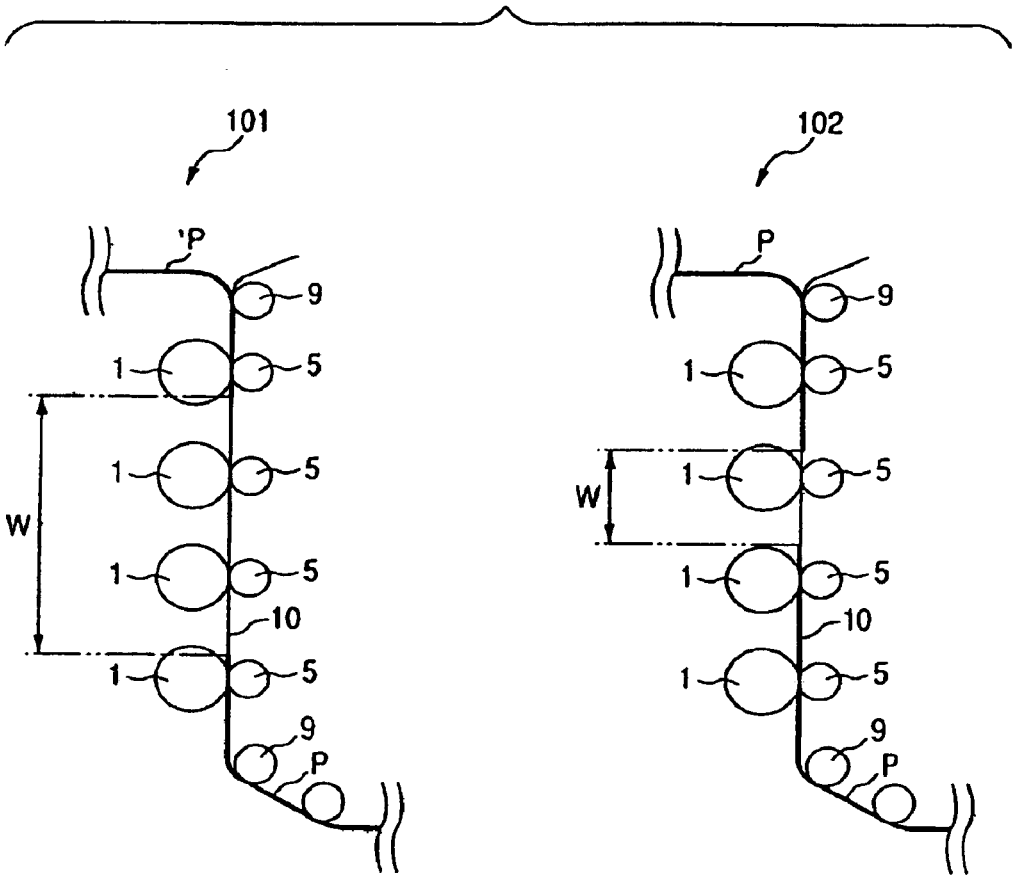
FIG. 2 is an illustration of the difference in the inter-sheet and life in the first embodiment.

In FIG. 2, each of the image forming apparatus 101 and 102 is of a construction which has yellow (Y), magenta (M), cyan (C) and black (Bk) image forming units arranged in tandem in succession from below. The transferring roller 5 in each apparatus functions as a transferring member and is provided at the position corresponding to each image forming unit. The transferring material P in each apparatus is conveyed by the transferring belt 10, and toner images are transferred by the transferring roller 5 through the transferring belts 10 to thereby form a full-color image on the transferring material P.

Here, each of these image forming apparatuses is provided with the photosensitive drums 1 constituted by the process cartridges 81 to 84 and the transferring rollers 5, repetitively used as image bearing members, and also rotatably driven in a counter-clockwise direction as viewed in FIG. 1 at a predetermined peripheral speed (process speed), the primary charging rollers 2 for uniformly charging the surfaces of the photosensitive drums 1, the developing devices 6, which are developing apparatuses for developing electrostatic latent images formed on the photosensitive drums 1, image exposing means, not shown, for exposing the surfaces of the photosensitive drums 1 to light to thereby form electrostatic latent images thereon, and the cleaning means 3 for removing any residual toners on the photosensitive drums 1.

Each of the image forming apparatuses 101 and 102 has mounting portions 111 to 114 for mounting the process cartridges 81 to 84 thereon, and the process cartridges are detachably attachable to the mounting portions.

In the present embodiment, each of the photosensitive drums 1 is a negatively charged organic photoconductive (OPC) photosensitive member having a diameter of 30 mm, and the peripheral speed thereof is 90 mm/sec.

Also, each of the primary charging rollers 2 constitutes a charging device of an AC contact-charging type which follows and contacts the photosensitive drum 1 to thereby effect charging, and the surface of the photosensitive drum 1 is charged to 600V by the primary charging roller 2 having applied thereto a bias comprising an AC voltage component of 2000 Vpp and 1000 Hz and a DC voltage component of −600V superimposed upon each other.

Also, the developing devices 6, as shown in FIG. 2, are provided with toner containing portions containing therein so-called non-magnetic toners of Y, M, C and Bk not containing magnetic materials, and developing rollers rotated in a forward direction relative to the photosensitive drums 1 by a rotatable driving device, not shown, and serve to develop the electrostatic latent images formed on the photosensitive drums 1, by a contact, one-component, contact developing process of applying a variable voltage to the developing rollers by the signal of a controller, not shown, and are disposed so as to be opposed to the photosensitive drums 1.

Also, the image exposing means, not shown, are comprised of laser diodes, polygon scanners, lens units, etc., and by receiving image exposure light from these image exposing means, electrostatic latent images corresponding to the first to fourth color component images (e.g., yellow, magenta, cyan and black component images) of a desired color image are formed on the photosensitive drums 1.

In the present embodiment, the image exposing means are polygon scanners using laser diodes.

Also, the writing-out of laser exposure is designed to be effected with a predetermined time delay from a position signal in the polygon scanner called BD for each scanning line in a main scanning direction (a direction orthogonal to the movement of the transferring material), and from a TOP signal starting from a switch in a conveying path in a sub-scanning direction (the direction of movement of the transferring material), whereby the exposure to the different color images can be effected on the photosensitive drums 1 in timed relationship with one another so that different color toner images can always be transferred to the same position on the transferring material P.

In the present embodiment, the cartridges are vertically arranged to minimize the grounded area of the image forming apparatuses. When cartridge interchange or jam treatment is to be effected, a front door (not shown) only is opened and closed. The front door is designed to be opened and closed with the transferring belt 10.

This transferring belt 10 is in contact with the photosensitive drums 1 with the transferring material P interposed therebetween when a sheet is supplied.

The difference between the image forming apparatus main body 101 and the image forming apparatus main body 102 will now be described with reference to FIG. 2. FIG. 2 typically shows the main bodies to illustrate the difference between the image forming apparatus main bodies 101 and 102 of FIG. 1. These main bodies differ from each other in the number of sheets printable within a minute. The image forming apparatus main body 101 can print 12 sheets within a minute. This is referred to as the main body of 12 prints per minute (ppm). On the other hand, the image forming apparatus main body 102 can print 16 sheets within a minute. This is referred to as the main body of 16 prints per minute (ppm). The routes of the transferring materials P in the two main bodies will hereinafter be described. The transferring material P fed by a sheet feeding roller is moved upwardly. The toner image formed on the photosensitive drum 1 for the first color (Y) from below is transferred to the transferring material P while being conveyed by the transferring belt 10 through the intermediary of the transferring roller 5. For the second to fourth colors M, C and Bk, the toner images on the photosensitive drums 1 are likewise successively superimposed and transferred onto the transferring material P. Lastly, the transferring material is directed to fixing means, not shown, where a color image is printed.

Here, the interval between a transferring material P and a transferring material P is called the inter-sheet W, and the inter-sheet W is 150 mm in the main body 101, and is 40 mm in the main body 102. In the main body 102, this inter-sheet W is shortened by suitably selecting the sheet-feeding construction and the temperature tempering of the fixing device. Specifically, in the sheet-feeding construction, the inter-sheet W was shortened by increasing the accuracy of the setting of the leading-edge position of the sheet and the response period of a sensor for detecting the leading-edge position. Also, in the fixing device, the inter-sheet W has been shortened in such a manner as to change the temperature tempering sequence to thereby better provide a heat resisting grade so that even if a pressure roller is not warmed in the inter-sheet, fixing can be effected.

On the other hand, it is known that the photosensitive drum is abraded in proportion to the number of revolutions thereof. In the main body 102, the inter-sheet W could be shortened and therefore, the number of revolutions of the photosensitive drums per unit number of sheets can be decreased and the life of the photosensitive drums can be lengthened.

In the case of a sheet of A4 size having a length of 297 mm, the length necessary per sheet in main body 101: 297+W=297+150=447 mm (1)

in main body 102: 297+W=297+40=337 mm (2)

and the life of the photosensitive drums can be lengthened to 447 mm/337 mm=1.33 times (3).

The main body control part of the image forming apparatus and a cartridge memory will now be described with reference to FIGS. 3A and 3B.

Figure 3A:
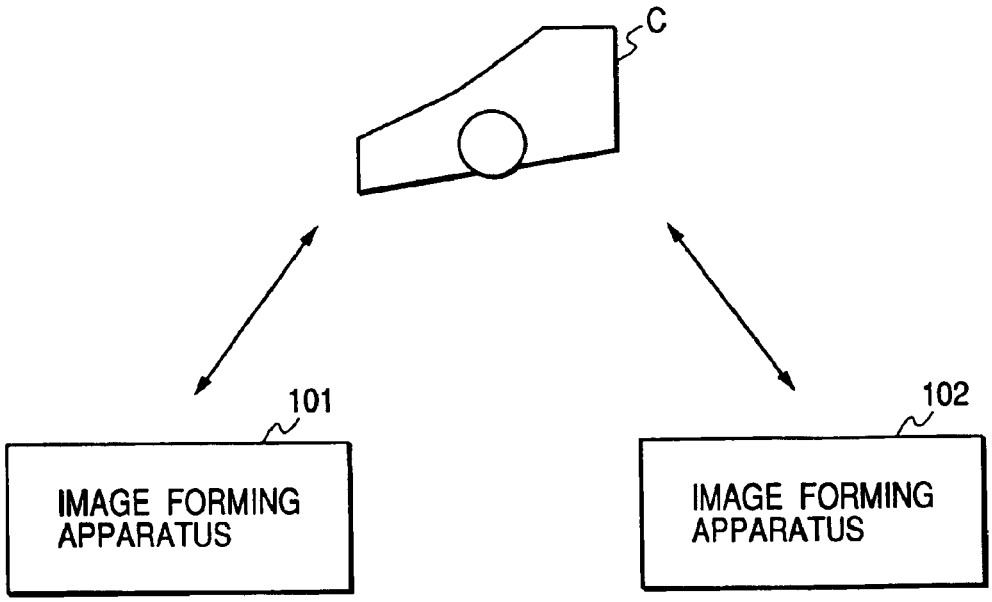
FIG. 3A shows an illustration of the relation between a process cartridge and image forming apparatus main bodies in the first embodiment.

FIG. 3A shows that a cartridge C can be mounted on both of the image forming apparatus 101 and the image forming apparatus 102.

Figure 3B:
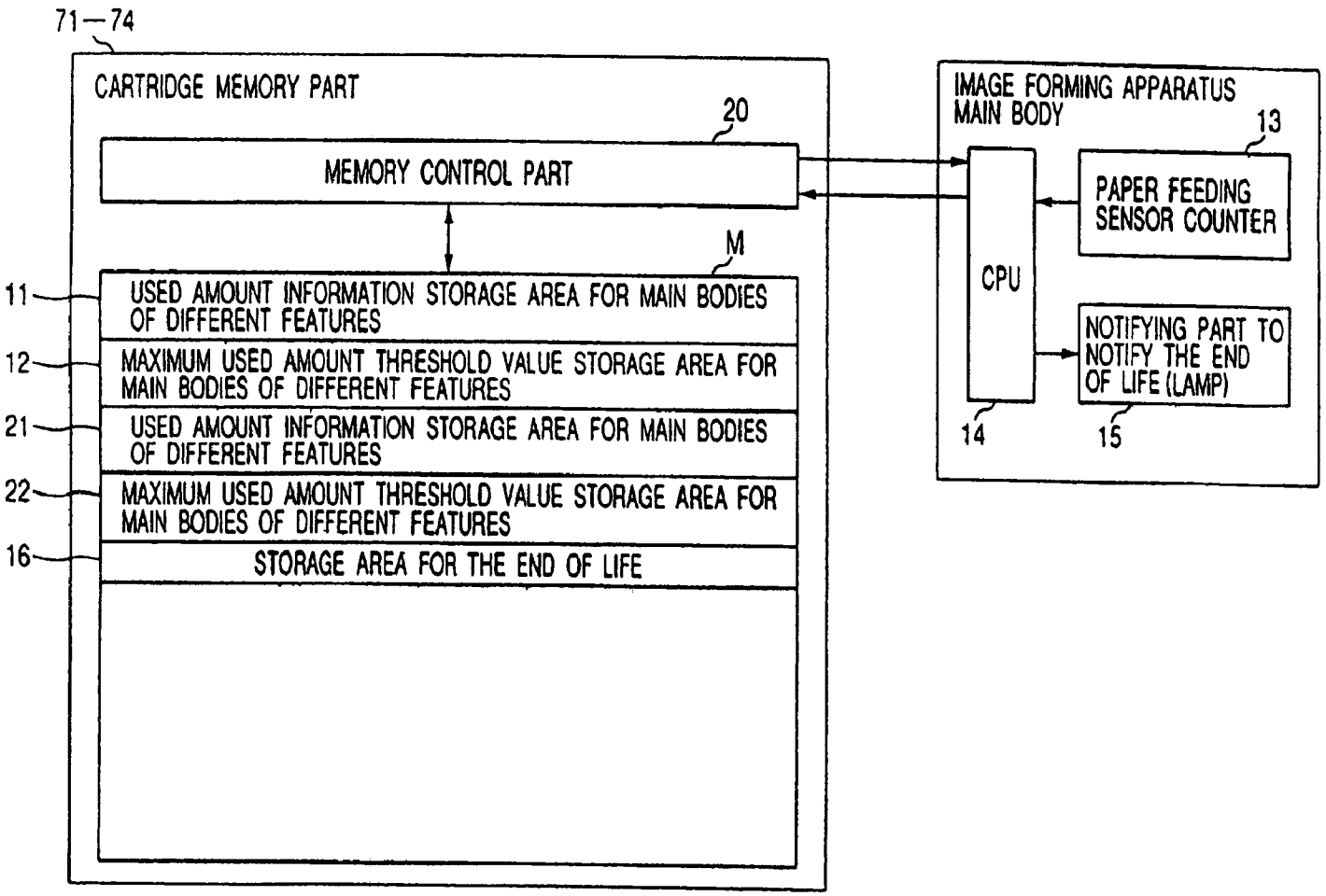
FIG. 3B shows the relation between a cartridge memory part and the control part of the image forming apparatus main body.

FIG. 3B is a block diagram showing the relation between the cartridge memory parts 71–74 and the control part (CPU) of the image forming apparatus main body.

The cartridge memory parts will first be described. The cartridge memory part has a storage element M for storing data therein and a memory control part 20 for controlling the reading-out and writing-in of data relative to the storage element M. The storage element M can be a nonvolatile memory, and for example, an NVRAM, an EEPROM, an FeRAM or the like can be used as the storage element M.

This storage element M is provided with storage areas for respective ones of the image forming apparatus main body 101 and the image forming apparatus main body 102 differing in features from each other. As the storage areas, there are a used amount information (number of recorded sheets) storage area 11 for main bodies 101 of different features, a maximum used amount (number of recorded sheets) threshold value storage area 12 for main bodies 101 of different features, a used amount information (number of recorded sheets) storage area 21 for main bodies of different features, and a maximum used amount information (number of recorded sheets) threshold value storage area 22 for main bodies 102 of different features.

Here, the maximum used amount threshold value information refers to information corresponding to the upper limit of the number of recorded sheets (used amount) recordable, for example, by the use of the image forming apparatus, and if the result of the calculation of the number of recorded sheets, which is the life value of the process cartridge to be described below, exceeds this threshold value when the process cartridge is inserted into each main body, the main body notifies the user of the end of the life of the process cartridge C. The storage element M further has a storage area 16 for information regarding the end of life (history information) indicating that the cartridge C has reached the end of its life. If the history information indicating that the cartridge C has reached the end of its life is stored in this storage area, the information can be read out to thereby find the state of the cartridge C, and when a process cartridge unknown to the main body is inserted, the end of the life of the cartridge can be determined on the spot without any extra life calculation being done.

This information indicative of the end of the life of the cartridge C may be bit information such as 0 or 1, or information indicative of a particular value may be written in.

The control part (CPU 14) of the image forming apparatus main body will now be described. The reference numeral 13 designates a sheet feeding sensor counter which reads the timing of sheet feeding by reading a signal from a sheet feeding sensor (not shown) in the image forming apparatus, and counts the fed sheets. Also, a signal indicative of being the image forming apparatus main body 101 is transmitted from the control part (CPU 14) of the image forming apparatus to the memory control part 20 of the process cartridge C. Further, a count value (number of recorded sheets) counted on the basis of a signal from the sheet feeding sensor is transmitted from the control part (CPU 14) to the memory control part 20 of the cartridge memory part. This counted and integrated value is a value corresponding to the used amount of the process cartridge.

The transmitted data is received by the memory control part 20 of the cartridge memory part, and is written into the number-of-sheets storage area of the storage element M for the main body 101 through the memory control part.

The above-mentioned count value is transmitted from the control part (CPU 14) of the image forming apparatus main body, for example, at predetermined timing after the termination of printing, and is written into the storage element M through the memory control part 20 of the cartridge memory part. The timing at which the count value is written into the storage element is not limited to after the termination of printing, but can be written at a suitable timing at a point in time at which the recording operation of the image forming apparatus main body has been completed.

Further, the CPU 14 reads out the threshold value information stored in advance in the maximum number of recorded sheets storage area of the storage element M of the cartridge C for the main body 101 and the count value written in the number of recorded sheets storage area for the main body 101, and compares the latter with the threshold value information and determines whether the cartridge C has reached the end of its life. If it is determined that the cartridge C has reached the end of its life, the CPU 14 turns on a lamp 15 for notifying the use of the end of the cartridge's life according to a signal indicative of the end of life, and also transmits history information indicative of the end of life to the cartridge memory part, and writes it into an end of life information storage area 16 through the memory control part.

When the cartridge C is mounted on the image forming apparatus 102, as when it is mounted on the image forming apparatus 101, a signal is transmitted from the control part (not shown) of the image forming apparatus 102 to the memory control part 20 of the cartridge memory part, and the memory control part 20 stores information regarding the image forming apparatus 102 into the storage area for the image forming apparatus 102.

As a method of displaying the end of life, use may be made of a method of displaying by a lamp (display device) as shown, or a method of transmitting an image forming signal to an external apparatus and causing a display part, such as a display in the external apparatus, to perform a display operation.

An end of life determination corresponding to each of the main bodies 101 and 102 according to the present invention will now be described with reference to FIGS. 4A and 4B.

In the present embodiment, the main body 101 and the main body 102 differ from each other in their inter-sheet length as previously described, and differ from each other in their process speed. Accordingly, it is necessary to effect an end of life determination (interchange time) conforming to the expression (3).

(1) Life (Interchange Time) of the Process Cartridge in the Main Body 101

Number of sheets in main body 101+Number of sheets in main body 102/Max 102×Max 101>Max 101 (4)

(2) Life (Interchange Time) of the Process Cartridge in the Main Body 102

Number of sheets in main body 101/Max 101×Max 102+Number of sheets in main body 102>Max 102 (5)

In the foregoing expressions,

Max 101: maximum number of sheets which can be supplied in main body 101 (number of sheets threshold value)

Max 102: maximum number of sheets which can be supplied in main body 102 (number of sheets threshold value) As shown in the expression (1), the inter-sheet is long in the main body 101, and as shown in the expression (2), the inter-sheet is short in the main body 102. From this difference in the inter-sheet, the life (interchange time) calculated from the reciprocal ratio between the movement distances of the photosensitive member and the developing roller or the like is 1.33 times from the expression (3). So, when the life (interchange time) of the process cartridge in the main body 101 is, e.g., 9000 sheets, the life (interchange time) in the main body 101 is the Number of sheets threshold value of main body 102=9000 sheets×1.33=12000 sheets. (6)

Accordingly,

Max 101: maximum number of sheets which can be supplied in main body 101 (number of sheets threshold value)=9000 sheets Max 102: maximum number of sheets which can be supplied in main body 102 (number of sheets threshold value)=12000 sheets.

Thus, the expression (4) and the expression (5) are:

(1) Life (Interchange Time) of the Process Cartridge in the Main Body 101

Number of sheets in main body 101+Number of sheets in main body 102/12000×9000>9000 (sheets) (7)

(2) Life (Interchange Time) of the Process Cartridge in the Main Body 102

Number of sheets in main body 101/9000×12000+Number of sheets in main body 102>12000 (sheets) (8)

The expression (7) is a life calculating expression of the main body 101. Also, the expression (8) is a life calculating expression of the main body 102. In the present invention, these expressions are used properly in the respective main bodies, whereby in whichever main body they are substituted, the end of life can be accurately calculated and found.

The expression (7) is the expression used when the cartridge is mounted on the main body 101, and accurately finds the used amount by converting the number of recorded sheets in the main body 102 into the number of recorded sheets in the main body 101 by the use of the ratio between the maximum number of sheets (number of sheets threshold value) 9000 which can be supplied in the main body 101 and the maximum number of sheets (number of sheets threshold value) 12000 which can be supplied in the main body 102.

The expression (8) is the expression used when the cartridge is mounted on the main body 102, and accurately finds the used amount by converting the number of recorded sheets in the main body 101 into the number of recorded sheets in the main body 102 by the use of the ratio between the maximum number of sheets (number of sheets threshold value) 9000 which can be supplied in the main body 101 and the maximum number of sheets (number of sheets threshold value) 12000 which can be supplied in the main body 102.

For example, as a case where the cartridge is alternately mounted on the main body 101 and the main body 102, let it be assumed that the process cartridge is first put into the main body 102, and then into the main body 101.

When the process cartridge has been mounted on the main body 102, the number of recorded sheets supplied in the main body 102 is stored in a used amount information storage area 21 for the main body 102 shown in FIG. 3B. Next, when this process cartridge is mounted on the main body 101, the number of recorded sheets supplied in the main body 101 is stored in a used amount information storage area 11 for the main body 101 shown in FIG. 3B.

When the process cartridge intactly reaches the end of its life (interchange time) in the main body 101, the number of recorded sheets supplied in the main body 102 is read out from the storage area 21 of the storage element M of the cartridge C in accordance with the expression (7), and is converted into a number of sheets corresponding to that in the main body 101 by the use of the ratio 9000/12000 between the threshold values of the numbers of recorded sheets, and the number of recorded sheets supplied in the main body 101 is added to that value. If this total number of sheets exceeds 9000 sheets, which is the number of sheets threshold value in the main body 101, the CPU 14 of the main body 101 in FIG. 3B determines it and turns on the lamp 15 for notifying the user of the end of the cartridge's life and also causes history information indicative of the end of life of the cartridge to be stored in the storage area 16 for the end of life signal information in the cartridge memory.

Figure 4A:
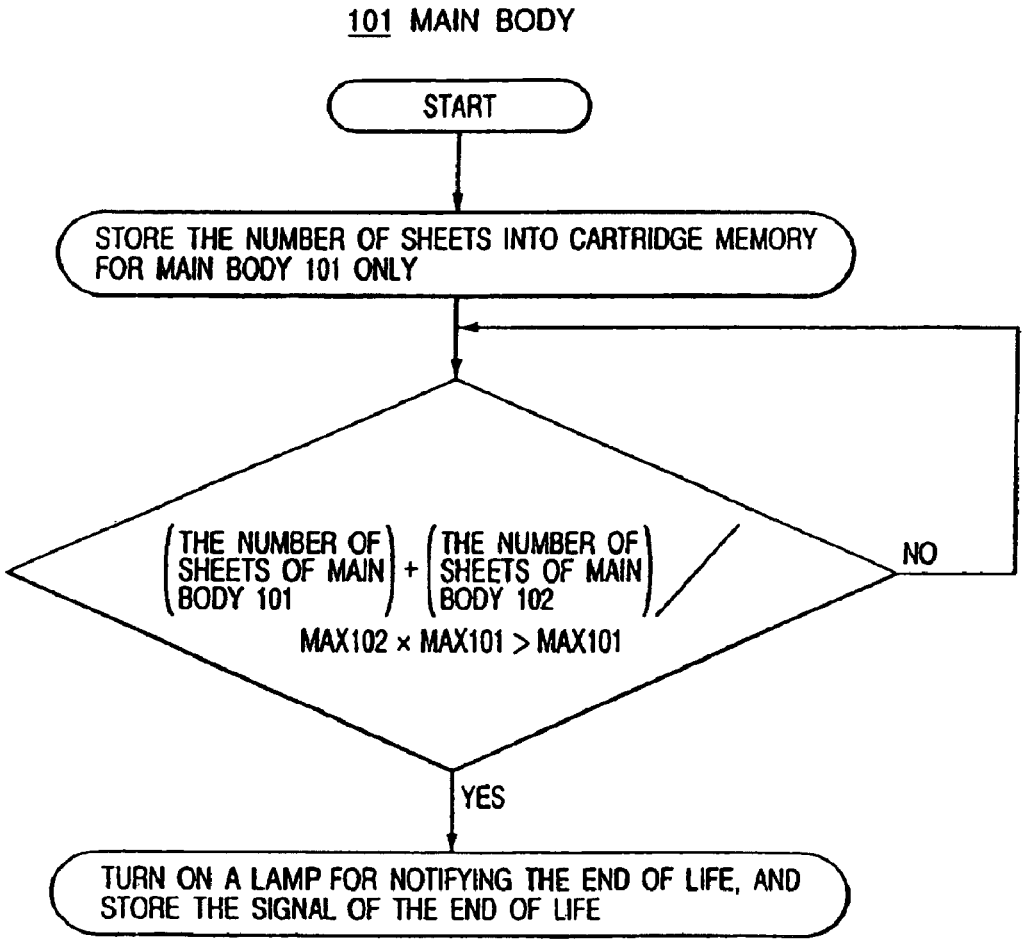
FIG. 4A is a flow chart schematically showing the operation of the main body 101 in the first embodiment.
Figure 4B:
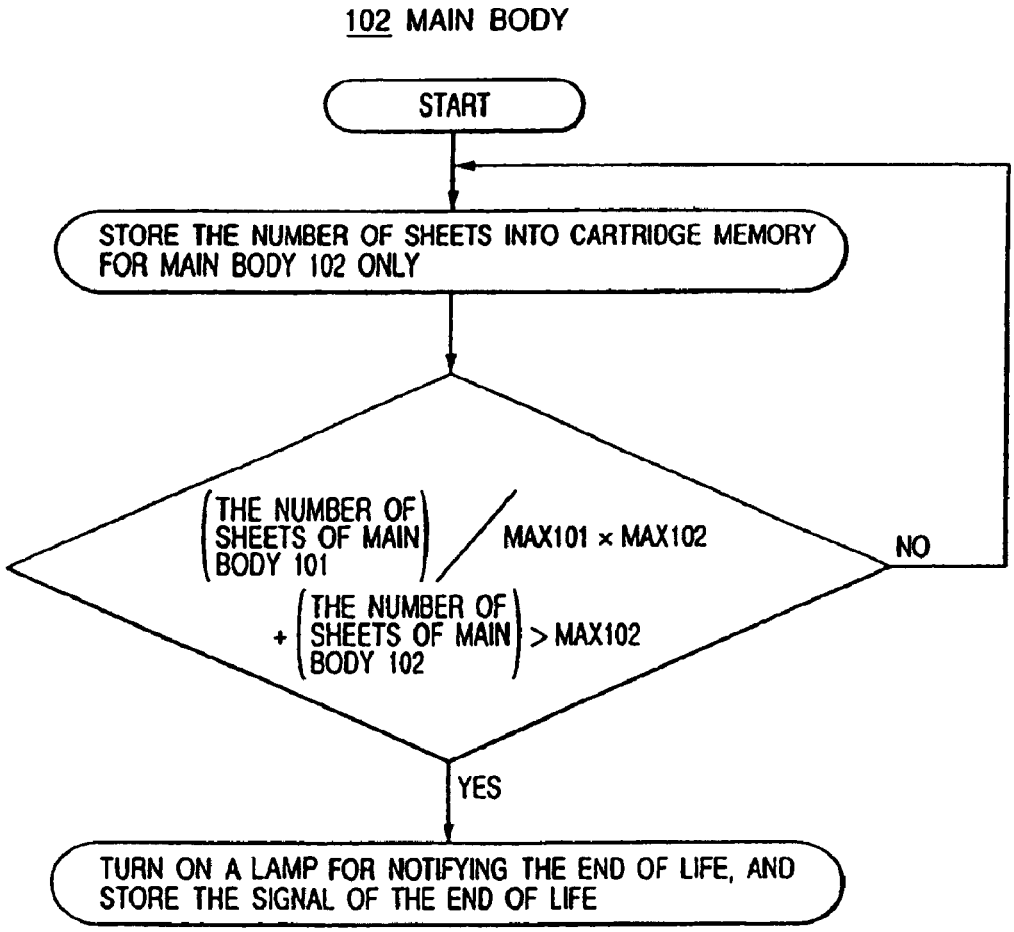
FIG. 4B is a flow chart schematically showing the operation of the main body 102 in the first embodiment.

The flow chart of FIG. 4A for the main body 101 is a flow chart of an end of life determination (a case following the expression (7)) in a state in which the cartridge has been mounted on the main body 101, and the flow chart of FIG. 4B for the main body 102 is a flow chart of the end of life (interchange time) determination (a case following the expression (8)) in a state in which the cartridge has been mounted on the main body 102.

When the process cartridge is always mounted on the main body 101, the number of sheets in the main body 102 is 0 in FIG. 4A and therefore, the end of life (interchange time) is reached at the threshold value of Max 101=9000 sheets.

Also, when the process cartridge is always mounted on the main body 102, the number of sheets in the main body 101 is 0 in FIG. 4B and therefore, the end of life (interchange time) is reached at the threshold value of Max 102=12000 sheets.

(Second Embodiment)

A second embodiment relates to a discrete main body 103 in which the charging process has been changed from an AC bias process to a DC bias process and the life of the photosensitive members has been lengthened, and will hereinafter be described with reference to FIG. 5.

Figure 5:
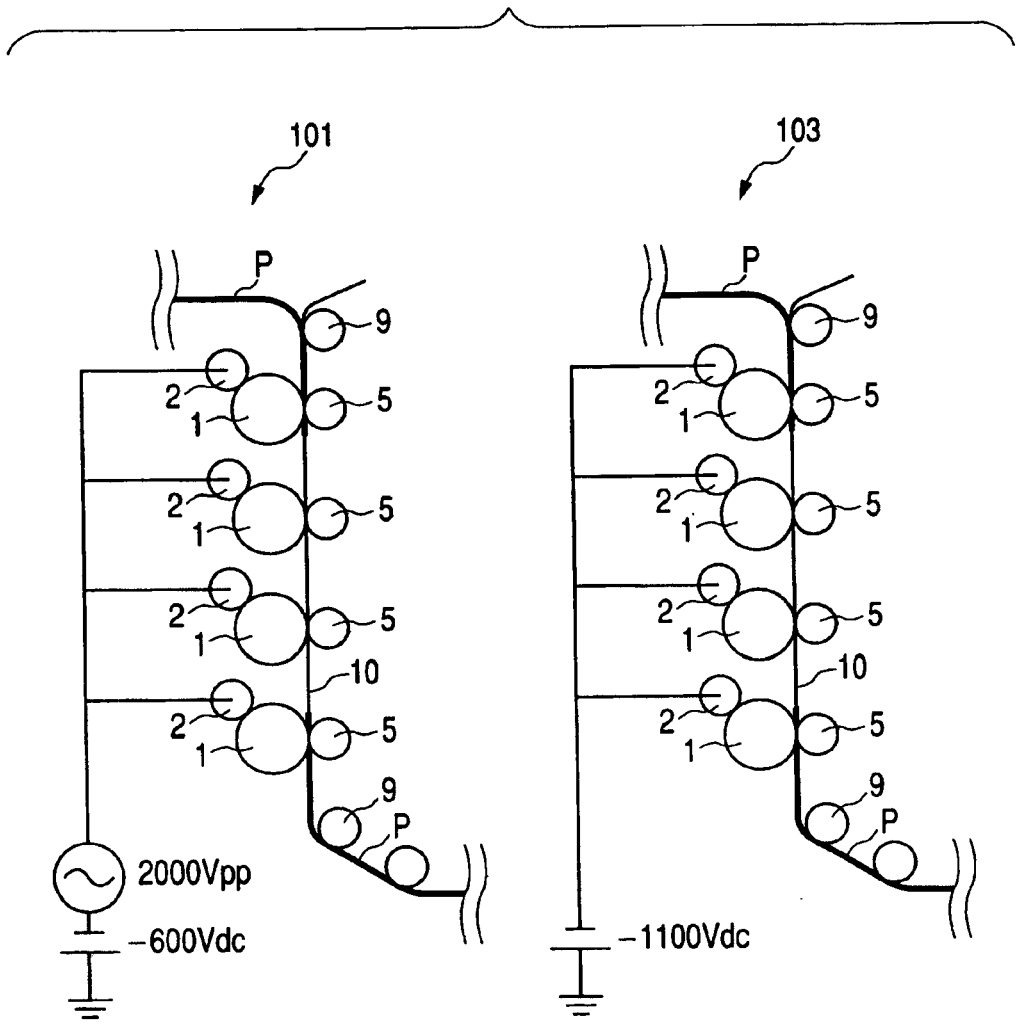
FIG. 5 is an illustration of image forming apparatuses differing in their charging processes in a second embodiment of the present invention.

FIG. 5 typically shows the main bodies to illustrate the difference between the image forming apparatus main bodies 101 and 103.

In FIG. 5, the main body 101 is the same main body as the main body 101 in the first embodiment, and an AC bias is applied to the charging rollers. On the other hand, in the main body 103, a DC bias is applied to the charging rollers.

The primary charging rollers 2 of the main body 101 constitute a charging apparatus of an AC contact-charging type which follows and contacts with the photosensitive drums 1 to thereby effect charging, and the surfaces of the photosensitive drums 1 are charged to −600V by the primary charging rollers 2 to which is applied a bias comprising an AC voltage component of 2000 Vpp and 1000 Hz and a DC voltage component of −600V superimposed upon each other.

The primary charging rollers 2 of the main body 103 constitute a charging apparatus of a DC contact-charging type which follows and contacts the photosensitive drums 1 to thereby effect charging, and the surfaces of the photosensitive drums 1 are charged to −600V by the primary charging rollers 2 to which a DC voltage of −1100V is applied. In the present embodiment, each of the photosensitive drums 1 is a negatively charged OPC photosensitive member having a diameter of 30 mm, and the peripheral speed thereof is 90 mm/sec.

The discharge amount of the AC charging process of the main body 101, as compared with the DC charging process of the main body 103, is great. Thus, the deterioration of the surfaces of the photosensitive drums is increased in proportion to the amount of discharge received. That is, in the main body 101, the photosensitive drums are more liable to be abraded than in the main body 103.

So, when the same process cartridges are mounted on the respective main bodies, the life (interchange time) as the process cartridge differs between the two main bodies. So, as in the first embodiment, the memory of the process cartridge is used to control the life (interchange time) in conformity with the respective main bodies.

A description will hereinafter be provided of the end of life (interchange time) determinations corresponding to the main bodies 101 and 103 according to the present invention.

In the present embodiment, the main body 101 and the main body 103, as previously described, differ in the life (interchange time) of the photosensitive drums due to the rubbing of the transferring portion. Accordingly, the life (interchange time) is determined by the following expressions.

(1) Life (Interchange Time) of the Process Cartridge in the Main Body 101

$$\text{Number of sheets in main body } \mathbf{101} + \text{Number of sheets in main body } \mathbf{103}/\text{Max } \mathbf{103} \times \text{Max } \mathbf{101} > \text{Max } \mathbf{101} \quad (9)$$

(2) Life (Interchange Time) of the Process Cartridge in the Main Body 103

$$\text{Number of sheets in main body } \mathbf{101}/\text{Max } \mathbf{101} \times \text{Max } \mathbf{103} + \text{Number of sheets in main body } \mathbf{103} > \text{Max } \mathbf{103} \quad (10)$$

In the foregoing expressions,

Max 101: maximum number of sheets which can be supplied in the main body 101 (number of sheets threshold value)

Max 103: maximum number of sheets which can be supplied in the main body 103 (number of sheets threshold value).

For example, the number of sheets threshold value which can be supplied in the main body 101 as Max 101 is 9000 sheets. On the other hand, the lower discharge amount of the main body 103 has decreased the abrasion of the photosensitive drums and the number of sheets threshold value has become 14000 sheets. So, assuming 14000 sheets as Max 103, as in the first embodiment, the proper life (interchange time) can be determined in the respective main bodies.

(Third Embodiment)

A third embodiment relates to a discrete main body 104 in which the rubbing pressure between the photosensitive drums and the transferring material P is decreased to thereby lengthen the life of the photosensitive drums, and will hereinafter be described with reference to FIG. 6.

Figure 6:
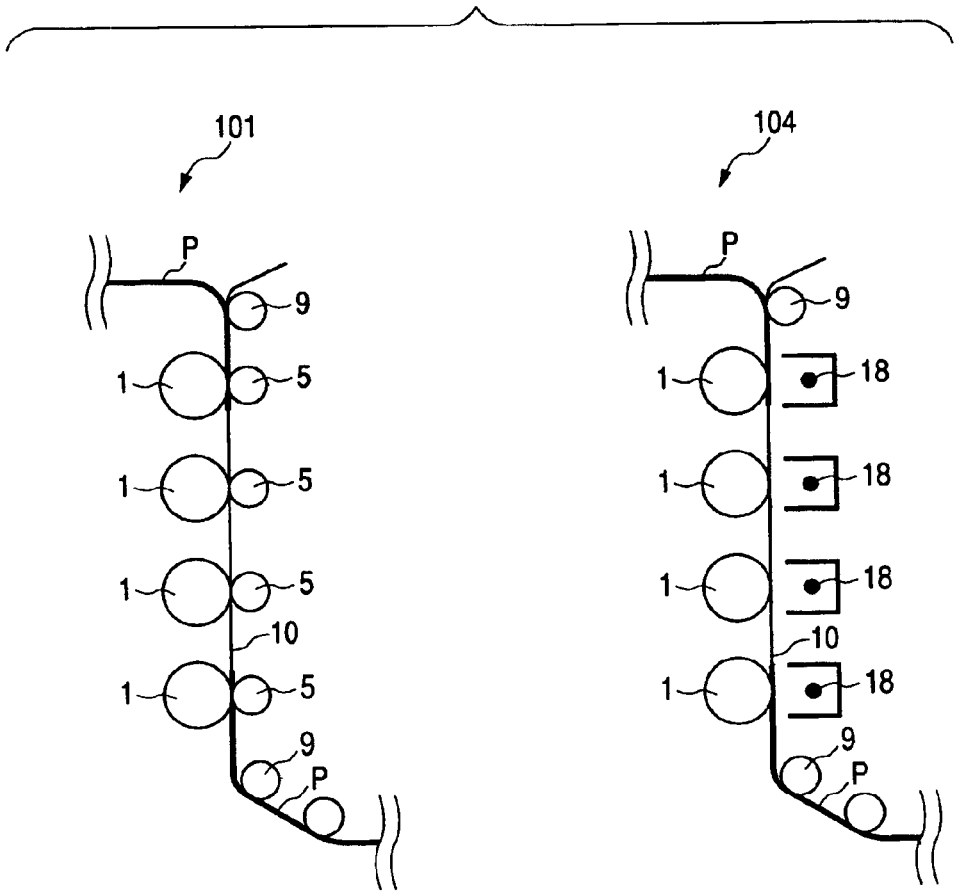
FIG. 6 is an illustration of image forming apparatuses differing in their transferring processes in a third embodiment of the present invention.

FIG. 6 typically shows the main bodies to illustrate the difference between the image forming apparatus main bodies 101 and 104.

In FIG. 6, the main body 101 is the same main body as the main body 101 in the first embodiment, and is provided with transferring rollers 5 as transferring members, and the transferring material P is conveyed by a transferring belt 10 and toner images are transferred by the transferring rollers 5 through the transferring belt 10. On the other hand, the main body 104 is provided with transferring coronas 18 as transferring members.

The transferring rollers 5 are pressed against the photosensitive drums 1 with the transferring belt 10 interposed therebetween with total pressure of 1 kg. On the other hand, the transferring coronas 18 do not contact the belt 10 and the transferring belt 10 is lightly in contact with the photosensitive drums 1.

The transferring belt 10 is in contact with the photosensitive drums 1 with the transferring material P interposed therebetween when sheets are supplied. The main body 101 is higher in contact pressure than the main body 104 and therefore, the photosensitive drums 1 are liable to rub against the transferring belt 10 and the photosensitive drums 1 are liable to be abraded.

The main body 101 and the main body 104 differ in the life of their respective photosensitive drums 1 due to the rubbing in the transferring part. So, when the same process cartridges are mounted on the respective main bodies, the life (interchange time) of the process cartridge differs between the two main bodies. So, as in the first embodiment, the memory of the process cartridge is used to control the cartridge life (interchange time) in conformity with the respective main bodies.

A description will hereinafter be provided of the end of life (interchange time) determinations corresponding to the main bodies 101 and 104 according to the present invention.

In the present embodiment, as previously described, the main body 101 and the main body 104 differ from each other in the life (interchange time) of their respective photosensitive drums due to the rubbing in the transferring part.

Accordingly, an end of life (interchange time) determination is effected on the basis of the following expressions.

(1) Life (Interchange Time) of the Process Cartridge in the Main Body 101

$$\text{Number of sheets in main body } \mathbf{101} + \text{Number of sheets in main body } \mathbf{104}/\text{Max } \mathbf{104} \times \text{Max } \mathbf{101} > \text{Max } \mathbf{101} \quad (11)$$

(2) Life (Interchange Time) of the Process Cartridge in the Main Body 104

$$\text{Number of sheets in main body } \mathbf{101}/\text{Max } \mathbf{101} \times \text{Max } \mathbf{104} + \text{Number of sheets in main body } \mathbf{104} > \text{Max } \mathbf{104} \quad (12)$$

In the foregoing expressions,

Max 101: maximum number of sheets which can be supplied in the main body 101 (number of sheets threshold value)

Max 104: maximum number of sheets which can be supplied in the main body 104 (number of sheets threshold value).

For example, the number of sheets threshold value which can be supplied in the main body 101 as Max 101 is 9000 sheets. On the other hand, the lack of contact between the transferring coronas 18 and the belt 10 decreased the abrasion of the photosensitive drums and the number of sheets threshold value became 10000 sheets. So, assuming 10000 sheets as Max 104, as in the first embodiment, a proper life (interchange time) can be determined in the respective main bodies.

While in the above-described first to third embodiments, a description has been provided of a process cartridge mountable on respective ones of two kinds of image forming apparatuses, use may be made of a process cartridge mountable on three or more kinds of image forming apparatuses.

Also, while in the above-described first to third embodiments, it has been taken as an example and described that the number of recorded sheets supplied for determining the life (interchange time) of the cartridge is stored in the memory of the cartridge, information other than the number of recorded sheets supplied may be used if it is information regarding the used amount for determining the life (interchange time) of the cartridge.

Also, while color image forming apparatuses have been described as an example, the present invention can also be applied to a monochromatic image forming apparatus.

Also, while in the above-described embodiments, a cartridge having a photosensitive drum which is an image bearing member, a primary charging roller, cleaning means, a cleaning container, a developing device and a storage part has been described as an example of the cartridge, the construction of the cartridge is not restricted thereto, but the present invention is also applicable, for example, to a cartridge having at least a developing device and a storage part.

As described in the foregoing embodiments, when a cartridge having interchangeability has been inserted into main bodies of different features, the used amount information thereof in the main bodies is stored in a storage medium provided on the cartridge, and even if the cartridge is mounted on and used in main bodies of different features, the life (interchange time) of the cartridge can be determined accurately.

Also, the used amount information when a cartridge having interchangeability has been inserted into main bodies of different features is stored in a storage medium provided on the cartridge, and it becomes possible to accurately determine the life (interchange time) of the cartridge from the used amount of the main body itself on which the cartridge is mounted and the used amount of the other main body.

Also, in a process cartridge having interchangeability wherein a threshold value corresponding to the life relative to different main bodies is also stored in the storage medium of the cartridge, a life (interchange time) corresponding to the main body can be determined accurately relative also to the different kinds of main bodies.

Also, history information indicating that a cartridge has reached the end of its life (interchange time) can also be stored in the storage medium of the cartridge to thereby effect an end of life (interchange time) determination on the spot when the cartridge has been mounted.

The present invention is not restricted to the above-described embodiments, but can cover modifications of the same technical idea.

What is claimed is:

1. An image forming apparatus comprising:

a mounting portion on which a cartridge is detachably mountable, the cartridge being detachably attachable to image forming apparatuses having different features and having at least some of members necessary for image forming and a storage part and having a storage area for storing therein information relating to the amount of use of each of the image forming apparatus to which the cartridge is attached; and a control part configured to determine an interchange time of the cartridge according to information stored in the storage part;

wherein said control part determines the interchange time of the cartridge based on the information of the amount of use of each image forming apparatus to which the cartridge was attached stored in the storage area of the storage part.

2. An image forming apparatus according to claim 1, wherein said control part calculates information for determining the interchange time of the cartridge according to information relating to the amount of use of said image forming apparatus stored in the storage part and information obtained by performing a conversion process on information relating to the amount of use of another image forming apparatus.

3. An image forming apparatus according to claim 2, wherein the storage part further has a storage area for storing therein information relating to a threshold value representing an upper limit of the amount of use of each image forming apparatus to which the cartridge is attached, and wherein said control part compares the information for determining the interchange time of the cartridge and the information relating to said threshold value with each other, and determines whether the cartridge has reached the interchange time thereof in accordance with the results of the comparison.

4. An image forming apparatus according to claim 3, wherein the storage part further has a storage area for storing therein history information indicating that the cartridge has reached the interchange time thereof, and wherein when said control part determines that the cartridge has reached the interchange time thereof, said control part writes into the storage area for storing the history information therein history information indicating that the cartridge is at the interchange time thereof.

5. An image forming apparatus according to claim 1, wherein the information relating to the amount of use of each of the image forming apparatuses represents the number of recorded sheets in each of said image forming apparatuses.

6. An image forming apparatus according to claim 1, wherein the members necessary for an image forming operation are an image bearing member, a charging member configured and positioned to charge the image bearing member, a cleaning apparatus configured and positioned to clean the image bearing member, and a developing apparatus configured and positioned to supply a developer to the image bearing member.

7. An image forming apparatus according to claim 6, wherein the image forming apparatuses having different features are image forming apparatuses differing from each other in the charging process and said charging member employed by the image forming apparatuses.

8. An image forming apparatus according to claim 6, wherein the image forming apparatuses having different features are image forming apparatuses having a transferring member for bringing a recording member into contact with said image bearing member, and differing from each other in the contact pressure of said transferring member.

9. An image forming apparatus according to claim 1, wherein the image forming apparatuses having different features are image forming apparatuses differing from each other in a conveying interval between transferring materials on which image forming is effected.

10. A cartridge comprising:

at least some members necessary for image forming; and a storage part, wherein said cartridge is detachably attachable to mounting portions of image forming apparatuses having different features, each image forming apparatus to which said cartridge is detachably attachable having a control part configured to determine an interchange time of said cartridge based on information stored in said storage part, wherein said storage part has a storage area for storing therein information relating to the amount of use in each of the image forming apparatuses to which the cartridge is attached.

11. A cartridge according to claim 10, wherein said storage part further has storage areas for storing therein information relating to threshold values representing upper limits of the amount of use of the image forming apparatuses.

12. A cartridge according to claim 10, wherein said storage part further includes a storage area for storing therein history information indicating that said cartridge has reached the interchange time.

13. A cartridge according to claim 10, wherein said members necessary for image forming are at least an image bearing member, a charging member configured and positioned to charge said image bearing member, a cleaning apparatus configured and positioned to clean said image bearing member, and a developing apparatus configured and positioned to supply a developer to said image bearing member.

14. A cartridge according to claim 13, wherein the image forming apparatuses having different features are image forming apparatuses differing from each other in a charging process by said charging member.

15. A cartridge according to claim 13, wherein the image forming apparatuses having different features are image forming apparatuses having a transferring member for bringing a recording member into contact with said image bearing member, and differing from each other in the contact pressure of the transferring member.

16. A cartridge according to claim 10, wherein the information relating to the amount of use in each of the image forming apparatuses represents the number of sheets on which an image is formed in the image forming apparatuses having different features.

17. A cartridge according to claim 10, wherein the image forming apparatuses having different features are image forming apparatuses differing from each other in a conveying interval between transferring materials on which image forming is effected.

18. A storage medium carried on a cartridge having at least some of members necessary for image forming and a storage part, and detachably attachable to the mounting portions of image forming apparatuses having different features, said storage medium having a storage area for storing therein information relating to the amount of use of each image forming apparatus to which the cartridge is attached.

19. A storage medium according to claim 18, further having storage areas for storing therein information relating to threshold values representing the upper limits of the amount of use of the image forming apparatuses.

20. A storage medium according to claim 18, further having a storage area for storing therein history information indicating that the cartridge has reached an interchange time.

21. A storage medium according to claim 18, wherein the members necessary for image forming are at least an image bearing member, a charging member configured and positioned to charge the image bearing member, a cleaning apparatus configured and positioned to clean the image bearing member, and a developing apparatus configured and positioned to supply a developer to the image bearing member.

22. A storage medium according to claim 21, wherein the image forming apparatuses having different features are image forming apparatuses differing from each other in a charging process by the charging member.

23. A storage medium according to claim 21, wherein the image forming apparatuses having different features are image forming apparatuses having a transferring member for bringing a recording member into contact with the image bearing member, and differing from each other in the contact pressure of the transferring member.

24. A storage medium according to claim 18, wherein the image forming apparatuses having different features are image forming apparatuses differing from each other in a conveying interval between transferring materials on which image forming is effected.

* * * * *